US006468125B1

(12) United States Patent
Nelson

(10) Patent No.: US 6,468,125 B1
(45) Date of Patent: Oct. 22, 2002

(54) YO-YO STRUCTURE

(76) Inventor: Michael T. Nelson, 6805 Garden Hwy., Sacramento, CA (US) 95837

( * ) Notice: Subject to any disclaimer, the term of this patent is extended or adjusted under 35 U.S.C. 154(b) by 0 days.

(21) Appl. No.: 09/896,725

(22) Filed: Jun. 29, 2001

(51) Int. Cl.[7] ..... A63H 1/30
(52) U.S. Cl. ..... 446/250
(58) Field of Search ..... 446/251, 250, 446/236, 247, 248

(56) References Cited

U.S. PATENT DOCUMENTS

| | | | | | |
|---|---|---|---|---|---|
| 1,784,684 | A | * | 12/1930 | Bell | 446/251 |
| 2,608,027 | A | * | 8/1952 | Perker et al. | 446/230 |
| 2,676,432 | A | * | 4/1954 | Field | 446/251 |
| 2,888,776 | A | * | 6/1959 | Sauer | 446/251 |
| 3,089,277 | A | * | 5/1963 | Reese | 446/176 |
| 3,256,635 | A | * | 6/1966 | Radovan | 446/251 |
| 4,081,924 | A | * | 4/1978 | Fabricant | 446/251 |
| 4,555,235 | A | * | 11/1985 | Burroughs | 446/243 |
| 4,693,695 | A | * | 9/1987 | Cheng | 446/220 |
| 6,123,596 | A | * | 9/2000 | Hsu | 446/250 |

FOREIGN PATENT DOCUMENTS

| | | | | |
|---|---|---|---|---|
| GB | GB 2156695 A | * | 10/1985 | A63H/01/30 |

* cited by examiner

*Primary Examiner*—Jacob K. Ackun
*Assistant Examiner*—Bena B. Miller
(74) *Attorney, Agent, or Firm*—Theodore J. Bielen, Jr.

(57) ABSTRACT

A yo-yo structure utilizing a pair of disks connected by a spindle. The disks form a groove to confine a line connected to the spindle. A cover of soft flexible material fits over at least one of the disks. A shield is fixed in the vicinity of the groove between the disks to prevent portions of the cover from entering the groove when the yo-yo is operating.

11 Claims, 2 Drawing Sheets

YO-YO STRUCTURE

BACKGROUND OF THE INVENTION

The present invention relates to a novel and useful yo-yo structure.

Yo-yos have been known since the early $20^{th}$ century and are believed to derive from the Philippines. Generally, yo-yos include a pair of disks that are connected to a spindle which is used to wind and unwind a cord. The yo-yo is then held by the user and flung outwardly causing the yo-yo-to spin and wind down the string and wind up the string back to the user. This operation is repeated. A variety of maneuvers may be performed with a yo-yo that serve as a source of amusement for many persons.

However, many persons are unable to perform the basic operation of a yo-yo due to difficulty in gripping the double disk body.

A yo-yo structure which is easy to grasp and includes a novel structure for the same would be a notable advance in the toy and game field.

BRIEF SUMMARY OF THE INVENTION

In accordance with the present invention a novel and useful yo-yo structure is herein provided.

The structure of the present invention utilizes a pair of disks connected to one another by a shaft or spindle to permit winding and unwinding of a line in the conventional sense. The pair of disks form a groove where the line, connected to the shaft, is extended from the shaft when the yo-yo is operated. The pair of disks may be formed of any hardened material, such as plastic or wood.

A cover of soft, flexible material having a plurality of flexible appendages is also employed in the present invention. The cover fits over at least one of the pair of disks, and preferably over both disks. The spinning of the pair of disks of the yo-yo also causes spinning of the flexible material and the appendages. Being soft, the flexible material is easy to hold and serves as a cushion for the movement of the yo-yo against the hand of the user.

Shield means is also found in the present invention for preventing the plurality of flexible appendages of the soft cover from entering the groove formed by the pair of disks. In this manner, the line, serving as a necessary element in the operation of the yo-yo, is not tangled or fouled in any way. The shield means also serves to cushion the finger of the user when the line of the yo-yo is wound around the central shaft and the body of the yo-yo, consisting of a pair of disks, is held in the hand of the user. The shield means also provides better control of the yo-yo hen it is tossed outwardly from the user. The shield means may be formed of resilient material or flexible material, as the case may be. In this regard, hardened rubber or similar compositions may be used to form the shield means of the present invention. The shield means may include a flange which extends from the disks that includes an inner surface that curves outwardly from the groove. The flange may form an endless edge about the disks to alleviate any gaps in the shield about the periphery of the pair of disks. Of course, the pair of flanges forming the shield means would balance the yo-yo structure so as not to interrupt the operation of the same.

It may be apparent that a novel and useful yo-yo structure has been herein before described.

It is therefore an object of the present invention to provide a yo-yo structure which includes a cover portion which is soft and pleasing to the touch.

Another object of the present invention is to provide a yo-yo structure which includes a soft cover portion having flexible appendages which do not upset the balance of the yo-yo structure.

A further object of the present invention is to provide a yo-yo structure having a plurality of flexible appendages on the side portions thereof which do not interfere with the line or string portion of the yo-yo structure.

Another object of the present invention is to provide a yo-yo structure which is easy to manufacture and is durable during use.

The invention possesses other objects and advantages especially as concerns particular characteristics and features thereof which will become apparent as the specification continues. dr

For a better understanding of the invention reference is made to the following detailed description of the preferred embodiments thereof which should be referenced to the prior described drawings.

DETAILED DESCRIPTION OF THE PREFERRED EMBODIMENTS OF THE INVENTION

Various aspects of the present invention will evolve from the following detailed description of the preferred embodiments thereof which should be taken in conjunction with the hereinabove described drawings.

Figure 1:
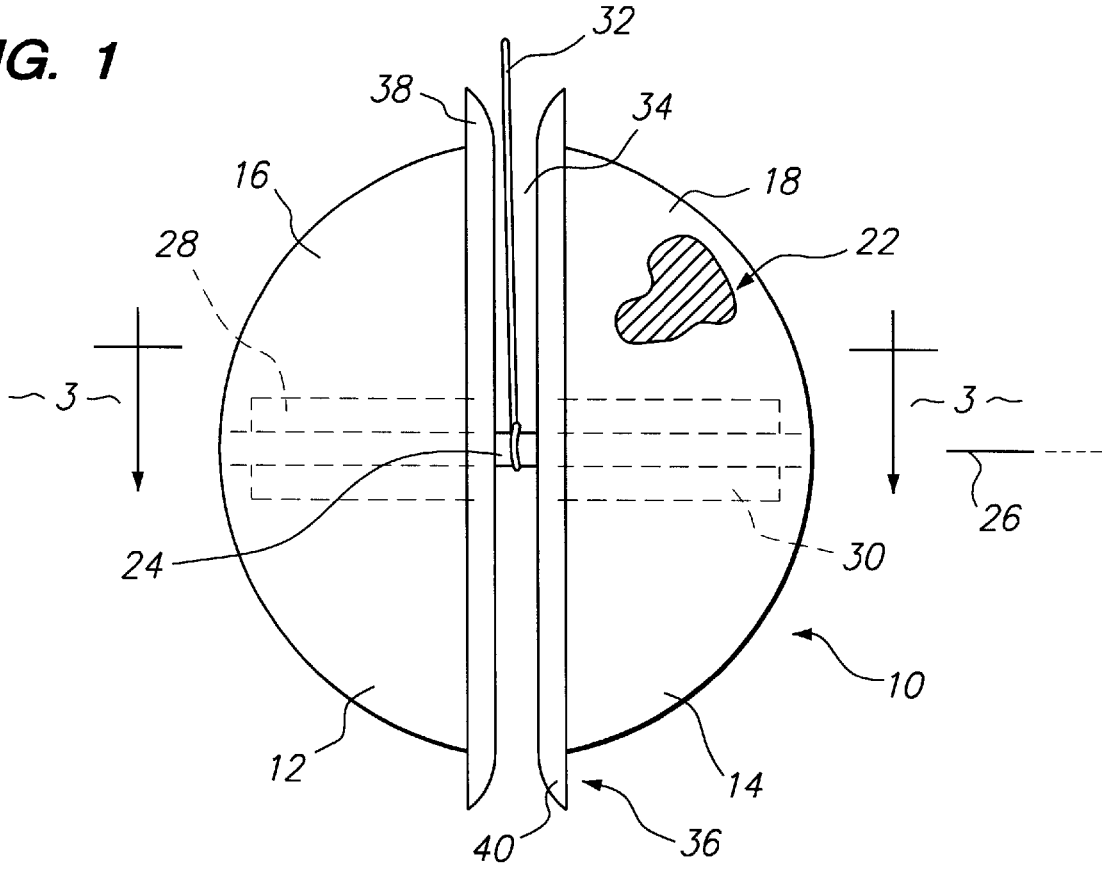
FIG. 1 is a front elevational view of the yo-yo structure of the present invention.
Figure 3:
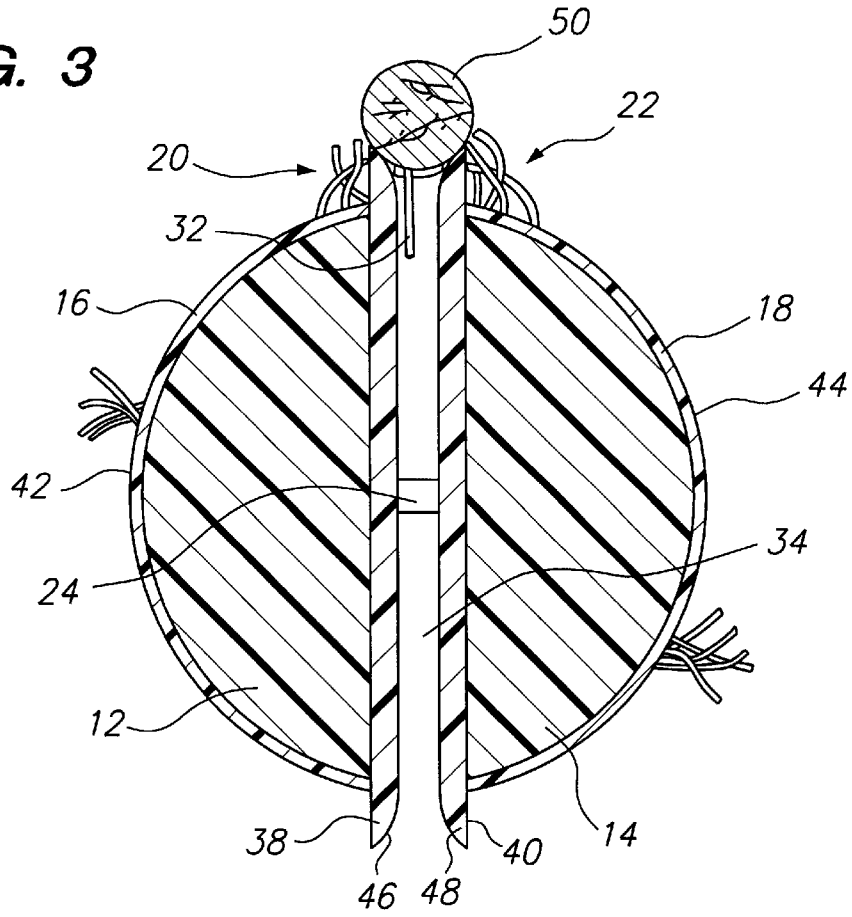
FIG. 3 is a sectional view taken along line 4—4 of FIG. 2.
Figure 4:
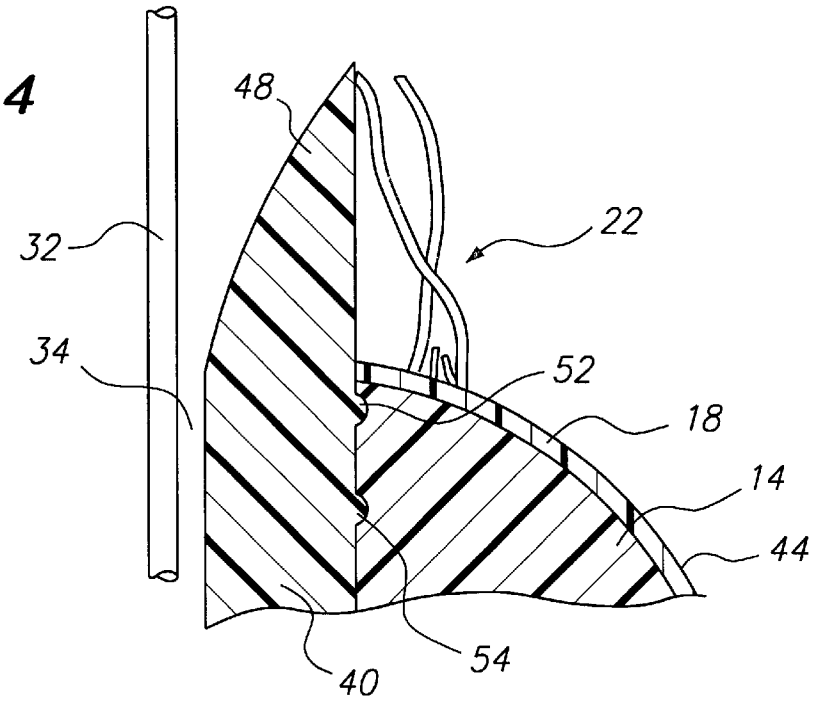
FIG. 4 is an enlarged sectional view of the shield means flange of the structure of the present invention.

The preferred embodiment of the invention as a whole is shown in the drawings by reference character 10. Yo-yo structure 10 includes as some of its elements disks 12 and 14. Each disk may be constructed of hard material such as plastic, wood, metal, and the like. As depicted in FIGS. 3 and 4, disks 12 and 14 are shown as being constructed of a hard plastic material. Covers 16 and 18 overlie disks 12 and 14, respectively. Covers 16 and 18 are formed of a soft pliant material such as a rubber. Each cover 16 and 18 includes a plurality of flexible and resilient appendages 20 and 22. As depicted in the drawings, plurality of flexible appendages are only partially drawn on covers 16 and 18 for the sake of simplicity. However, it should be understood that plurality of flexible appendages 20 and 22 may project from the entire outer surfaces of covers 12 and 14. It should be noted that plurality of appendages 22 on cover 14 of FIG. 1 are shown schematically. Covers 16 and 18 may be fastened to disks 12 and 14 by any suitable means such as fusion, adhesives, and the like.

Structure 10 further includes a shaft or spindle 24 which extends along the central axis 26 of structure 10. Bosses 28 and 30 embedded in disks 12 and 14, respectively, hold shaft 24 in place. A line or string 32 is looped or wrapped around shaft 24 exposed in groove 34 separating disks 12 and 14. In the conventional manner, line 32 winds around shaft 24 in groove 34 as the yo-yo structure 10 is operated in the normal manner. Shield means 36 is also found in the structure 10 of the present invention. Shield means 36 takes the form of a pair of flanges 38 and 40 which are held to disks 12 and 14 by any fastening means such as friction fitting, gluing, welding, and the like. Flanges 38 and 40 extend outwardly from the outer surfaces 42 and 44 of cover 16 and 18, respectively and form the inner confines of groove 34. With reference to FIG. 3, it may be observed that covers 38 and 40 includes curved inner end portions 46 and 48. Finger 50 easily rests on curved inner end portions 46 and 48, which may be formed of a hardened rubber-like material. Finger 50 may be the index finger or pointing finger of a hand, which is typically employed in the operation of a yo-yo such as yo-yo structure 10. Of course, line 32 is looped around finger 50 to facilitate the operation of yo-yo structure 10.

With reference to FIG. 4, it may be observed that flange 40 is depicted in greater detailed and is intended to be representative of flange 38 which is the mirror image thereof. End portion 48 is shown as extending outwardly from surface 44 of cover 18 to prevent any of the plurality of appendages 22 from entering groove 34 during the operation of yo-yo structure 10. Ridges 52 and 54 are also shown to aid in the connection of flange 48 to disk 14.

Figure 2:
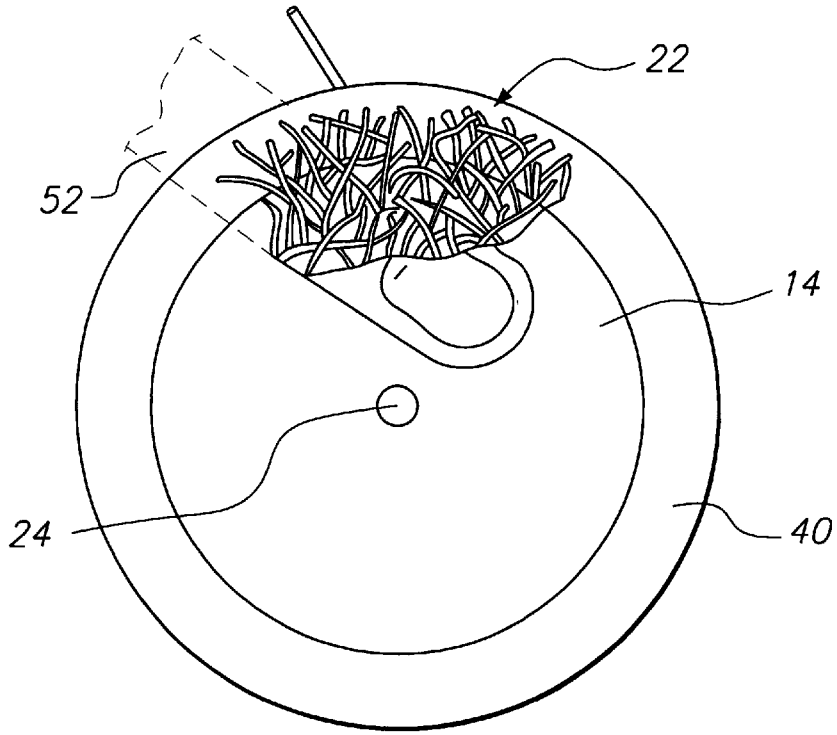
FIG. 2 is a side elevational view of the yo-yo structure of the present invention showing a human finger partially in phantom.

In operation, the user winds line 32 around spindle 24 and places a finger 50 through a loop in line 32. Yo-yo structure 10 is then operated inwardly and outwardly in the normal manner causing the spinning of disks 12 and 14. Plurality of flexible appendages 20 and 22 of covers 16 and 18 and plurality of resilient appendages 20 and 22 spin during the operation of yo-yo structure 10. Despite the spinning of disks 12 and 14, covers 16 and 18 and appendages 20 and 22 serve as a soft gripping surface for the hand of the user represented by finger 52 of FIG. 2. During the inwardly and outwardly motion of yo-yo structure 10, plurality of appendages 20 and 22 do not enter groove 34, which would interfere with the winding and unwinding of line 32 around spindle or shaft 24, due to the position of flanges 38 and 40. The curved inner end portions 46 and 48 of flanges 38 and 40 serves as a soft resting place for finger 50 around which string or line 32 is looped. Thus, yo-yo structure 10 presents a novel feel and appearance to the user when operated by the user.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A yo-yo structure, comprising:

a. a pair of disks connected by a shaft to permit winding of a line, said pair disks forming a groove therebetween, said line extending from said shaft through said grove;

b. a cover of soft, flexible material having a plurality of flexible appendages extending outwardly therefrom, said cover fitting over at least one of said pair of disks; and c. shield means for preventing any of said plurality of flexible appendages from entering said groove formed by said pair of disks.

2. The structure of claim 1 in which said shield means comprises a flexible member.

3. The structure of claim 2 in which said shield means comprises a resilient member.

4. The structure of claim 1 in which said means comprises a flange extending from at least one of said pair of disks.

5. The structure of claim 4 in which said flange carves outwardly relative to said groove.

6. The structure of claim 4 in which said shield means comprises a flexible member.

7. The structure of claim 6 in which said shield means comprises a resilient member.

8. The structure of claim 1 in which said shield means comprises a pair of flanges one of said pair of flanges extending from each of said pair of disks.

9. The structure of claim 8 in which each of said pair of disks includes an endless edge spaced from said shaft and one of said pair of flanges overlaps and extends from said of each of said pair of disks.

10. The structure of claim 8 in which each of said pair of flanges comprises a flexible member.

11. The structure of claim 8 in which each of said pair of flanges comprises a resilient member.

* * * * *